US006146028A

United States Patent [19]

Preszler

[11] Patent Number: 6,146,028

[45] Date of Patent: Nov. 14, 2000

[54] APPARATUS AND METHOD FOR COOLING A THERMALLY PROCESSED MATERIAL

[75] Inventor: Duane A. Preszler, Riverfalls, Wis.

[73] Assignee: Eastman Kodak Company, Rochester, N.Y.

[21] Appl. No.: 09/245,507

[22] Filed: Feb. 5, 1999

[51] Int. Cl.[7] ..... G03D 13/00

[52] U.S. Cl. ..... 396/575; 355/27; 355/400; 396/579; 34/639

[58] Field of Search ..... 396/575, 579, 396/612; 355/30, 27–29, 400, 407; 428/90; 34/79, 82, 90; 430/31; 219/216

[56] References Cited

U.S. PATENT DOCUMENTS

| | | | |
|---|---|---|---|
| 1,378,721 | 5/1921 | Rohdiek | 219/244 |
| 3,570,383 | 3/1971 | Berg | 396/579 |
| 3,817,618 | 6/1974 | Riley et al. | 355/100 |
| 4,322,158 | 3/1982 | Frias et al. | 355/27 |
| 4,485,294 | 11/1984 | Rosenberg | 219/216 |
| 5,023,654 | 6/1991 | Matsumoto et al. | 355/27 |
| 5,352,863 | 10/1994 | Svendsen | 219/388 |
| 5,414,488 | 5/1995 | Fujita et al. | 355/30 |
| 5,502,532 | 3/1996 | Biesinger et al. | 354/298 |
| 5,563,681 | 10/1996 | Kirkwold et al. | 355/30 |
| 5,699,101 | 12/1997 | Allen | 347/212 |
| 5,849,388 | 12/1998 | Preszler et al. | 428/90 |
| 5,895,592 | 4/1999 | Struble et al. | 396/579 |

FOREIGN PATENT DOCUMENTS

| | | | |
|---|---|---|---|
| 0 476 694 A2 | 3/1992 | European Pat. Off. | G03B 27/30 |
| 0 679 946 A1 | 11/1995 | European Pat. Off. | G03D 13/00 |
| 0 679 947 A1 | 11/1995 | European Pat. Off. | G03D 13/00 |

*Primary Examiner*—D. Rutledge
*Attorney, Agent, or Firm*—William F. Noval

[57] ABSTRACT

An apparatus and method for cooling a thermally processed, imaging material which has been heated to a first temperature by a thermal processor is disclosed. The cooling apparatus includes a cooling article, on which the imaging material rides after the imaging material exits the thermal processor, and an imaging material transport mechanism. The cooling article is at a lower temperature than the first temperature to cool the imaging material. The transport mechanism conveys the imaging material over the cooling article. The imaging material transport mechanism includes a first roller, a second roller and a displacement mechanism. The displacement mechanism effects relative movement between the first and second rollers between a first position and a second position. In the first position, the first and second rollers engage the imaging material to convey the imaging material over the cooling article. In the second position, The imaging material is substantially freely movable relative to the first and second rollers. By allowing the imaging material to move freely relative to the first and second rollers prior to the imaging material substantially exiting the thermal processor, imaging material defects during cooling are minimized.

37 Claims, 9 Drawing Sheets

APPARATUS AND METHOD FOR COOLING A THERMALLY PROCESSED MATERIAL

TECHNICAL FIELD

This invention relates to photothermographic processors that use thermally processable film. In particular, the present invention is an apparatus and method for cooling a thermally developed film so as to minimize physical and image defects in the developed film that would adversely affect the quality of the resulting film image.

BACKGROUND OF THE INVENTION

Various medical, industrial and graphic imaging applications require the production of very high quality images. One way to produce high quality images is through the use of a photothermographic processor. One type of photothermographic processor uses a thermally processable, light sensitive photothermographic film that typically includes a thin polymer base coated with an emulsion of dry silver or other heat sensitive material. This photothermographic film may take the form of short sheets, longer lengths or continuous rolls of photothermographic material. These sheets, lengths and rolls are often referred to as photothermographic elements.

A photothermographic processor generally includes a photothermographic element exposure system, a thermal processing mechanism and a cooling apparatus. The exposure system typically employs a laser scanner device that produces laser light that exposes the photothermographic element to form a latent image thereon. The thermal processing mechanism is used to thermally develop this latent image. To develop the latent image, the thermal processing mechanism heats the exposed photothermographic element to at least a threshold development temperature for a specific period of time to develop the image within the photothermographic element. Subsequently, the photothermographic element must be cooled by the cooling apparatus of the photothermographic processor to allow a user to hold the element while examining the developed image.

During cooling, the photothermographic element is susceptible to physical and image defects. These defects are primarily due to uneven cooling of the developed photothermographic element and dimensional changes that occur in the element during cooling. Uneven cooling across the developed photothermographic element and uncontrolled dimensional changes which occur during cooling cause thermal stresses and contraction or expansion within the element. These thermal stresses and contraction or expansion can cause physical and image wrinkles, streaks and/or spots (i.e., defects), in the developed photothermographic element, which can significantly affect the quality of the developed image.

In addition to the physical and image defects that can occur during cooling, a photothermographic element is also susceptible to physical and image defects caused in other ways. For example, physical and image defects can occur in the photothermographic element due to a speed mismatch, wherein an element transport mechanism of the cooling apparatus is moving at a speed different than the speed of a conveyance device of the thermal processing mechanism.

If the element transport mechanism of the cooling apparatus is moving at a speed slower than the speed of the conveyance device of the thermal processing mechanism, buckling of the photothermographic element can occur due to the excess buildup of the element in the cooling apparatus. Buckling of the photothermographic element within the thermal processing mechanism can result in uneven contact between heated development rollers of the thermal processing mechanism and the element during the development process. This uneven contact can cause underdevelopment of portions of the latent image, thereby resulting in image artifacts that adversely affect the quality of the developed image. Buckling of the photothermographic element within the cooling apparatus can result in uneven cooling of the element, resulting in image affecting physical defects within the photothermographic element and possible element jams.

If the element transport mechanism of the cooling apparatus is moving at a speed faster than the speed of the conveyance device of the thermal processing mechanism, slippage must occur between the photothermographic element and the element transport mechanism of the cooling apparatus, or between the element and the conveyance device of the thermal processing mechanism, or between the element and both of the transport mechanism and the conveyance device. This slippage of the photothermographic element can cause areas of high tension in the element in a down-web direction (i.e., parallel to the direction of travel of the photothermographic element). These areas of high tension can cause physical and image defects, such as wrinkles, in the photothermographic element during cooling of the element.

A photothermographic element is further susceptible to physical and image defects caused in other ways. For example, the element transport mechanism that moves the photothermographic element through the cooling apparatus generally takes the form of a pair of nip rollers. These nip rollers by their design nature, prohibit cross-web (i.e., perpendicular to the direction of travel of the photothermographic element) expansion or contraction of the photothermographic element. This prohibition of cross-web expansion and contraction of the photothermographic element can cause physical and image defects, such as wrinkles, in the element during cooling thereof. This type of defect is particularly acute when the width of the photothermographic element is large (i.e., in excess of 18"). In addition, the design nature of the nip rollers of the cooling apparatus requires that the photothermographic element enter the nip rollers relatively straight or a skew in the direction of travel of the element can occur. This directional skew of the photothermographic element can result in non-uniform contact between a cooling article of the cooling apparatus and the element during the cooling process. This non-uniform contact can result in uneven cooling of the photothermographic element, resulting in image affecting physical defects within the element and possible element jams.

There is a need for an improved apparatus and method for cooling thermally processed, photothermographic elements. In particular, there is a need for a photothermographic element cooling apparatus and method which sufficiently cools a developed photothermographic element to allow a user to hold the element for examining the developed image, and minimizes physical and image defects in the developed image that would adversely affect the image quality of the developed photothermographic element. In addition, the photothermographic element cooling apparatus and method should provide these features while offering acceptable cooling productivity, cost effectiveness, and ease of assembly and repair.

SUMMARY OF THE INVENTION

The present invention is an apparatus and method for cooling a thermally processed, imaging material which has been heated to a first temperature by a thermal processor. The cooling apparatus includes a cooling article on which the imaging material rides after the imaging material exits the thermal processor, and an imaging material transport mechanism. The cooling article is at a second temperature that is lower than the first temperature so as to cool the imaging material. The imaging material transport mechanism is adjacent to the cooling article and engages the imaging material to convey the imaging material over the cooling article. The imaging material transport mechanism includes a first roller, a second roller and a displacement mechanism. The displacement mechanism effects relative movement between the first and second rollers between a first position and a second position. In the first position, the first and second rollers engage the imaging material to convey the imaging material over the cooling article. In the second position, The imaging material is substantially freely movable relative to the first and second rollers.

In practice, an initial portion of the heated imaging material is cooled by transporting the heated imaging material over the cooling article using only an imaging material conveyance device of the thermal processor. During cooling of this initial portion of the heated imaging material, the first and second rollers are in the second position and the imaging material is substantially freely moveable relative to the first and second rollers. Prior to the heated imaging material exiting the imaging material conveyance device of the thermal processor, the first and second rollers are moved to the first position. A further portion of the imaging material is then cooled by transporting the heated imaging material over the cooling article using both the imaging material conveyance device and the first and second rollers of the imaging material transport mechanism. A final portion of the heated imaging material is cooled by transporting the heated imaging material over the cooling article using only the first and second rollers of the imaging material transport mechanism.

This cooling apparatus and method minimizes formation of physical and image defects during cooling of the imaging material. Because the heated imaging material is substantially freely movable relative to the rollers of the transport mechanism during substantially the entire transport of the imaging material through the thermal processor, any formation of imaging material physical and image defects due to a speed mismatch between the conveyance device and the transport mechanism is essentially eliminated. Since only the conveyance device primarily conveys the heated imaging material over the cooling article during the transport of the imaging material through the processor, and since only the transport mechanism primarily conveys the imaging material over the cooling article once the imaging material has exited the thermal processor, buckling of the imaging material or slippage induced high tension in the imaging material due to a speed mismatch, and the subsequent defects caused thereby, are minimized.

Moreover, substantially free movement of the heated imaging material relative to the rollers of the transport mechanism, during substantially the entire transport of the imaging material through the thermal processor, permits cross-web expansion and contraction of the imaging material. By permitting cross-web expansion and contraction during cooling, the formation of physical and image defects, that would otherwise occur in the imaging material if cross-web expansion and contraction were not permitted, are virtually eliminated. In addition, substantially free movement of the heated imaging material relative to the rollers of the transport mechanism, during substantially the entire transport of the imaging material through the thermal processor, allows the heated imaging material to enter the transport mechanism in a skewed condition while still maintaining uniform contact with the cooling article. This uniform contact minimizes the formation of imaging material physical and image defects caused by uneven cooling of the imaging material, and the possibility of imaging material jams. The cooling apparatus of the present invention minimizes physical and image artifacts while offering acceptable cooling productivity, cost effectiveness and ease of assembly and repair. The overall result is a significant improvement in the quality of the developed image on the imaging material.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
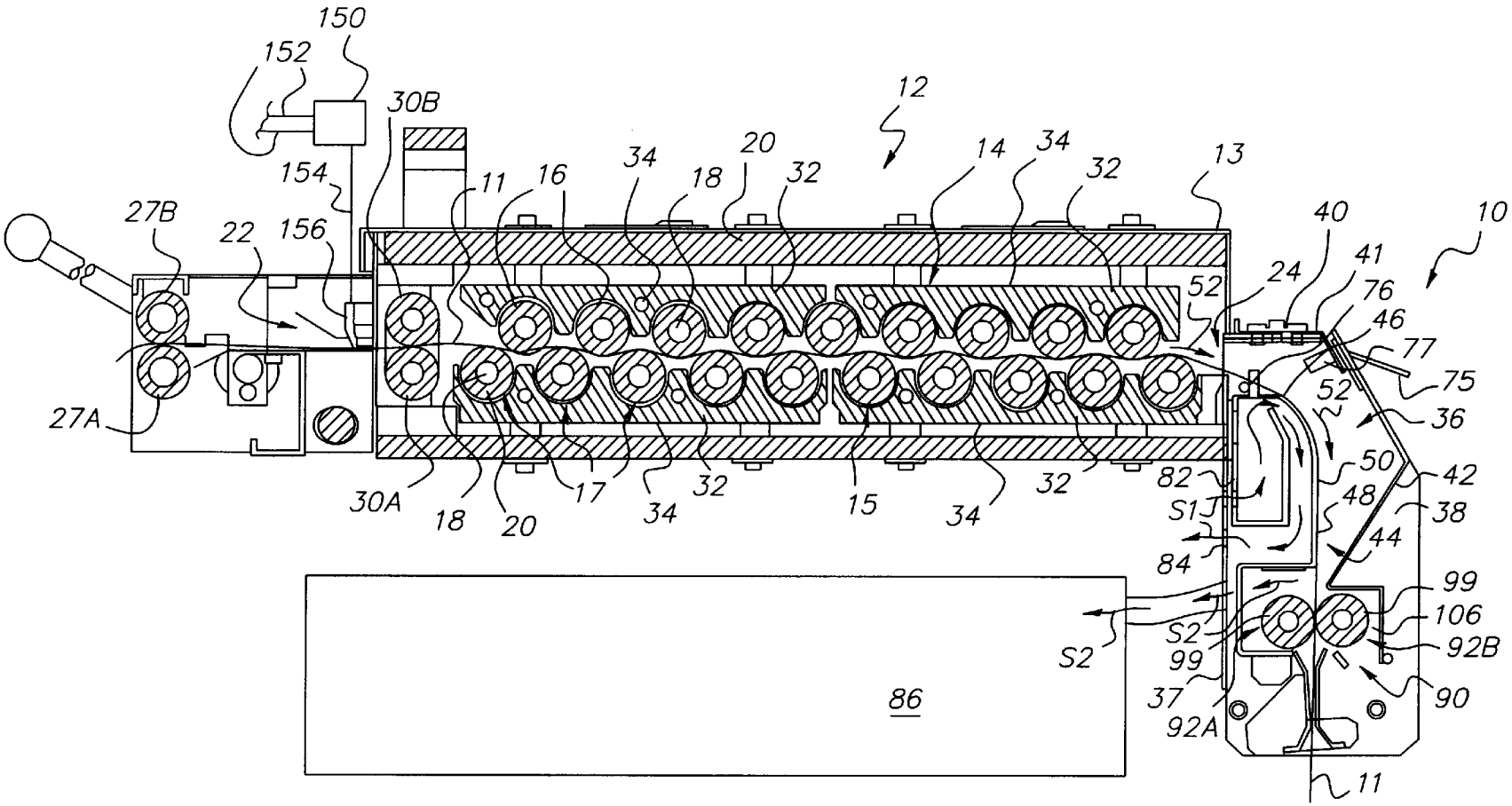
FIG. 1 is a side sectional view of a photothermographic processor incorporating an apparatus for cooling thermally processed material in accordance with the present invention.
Figure 2:
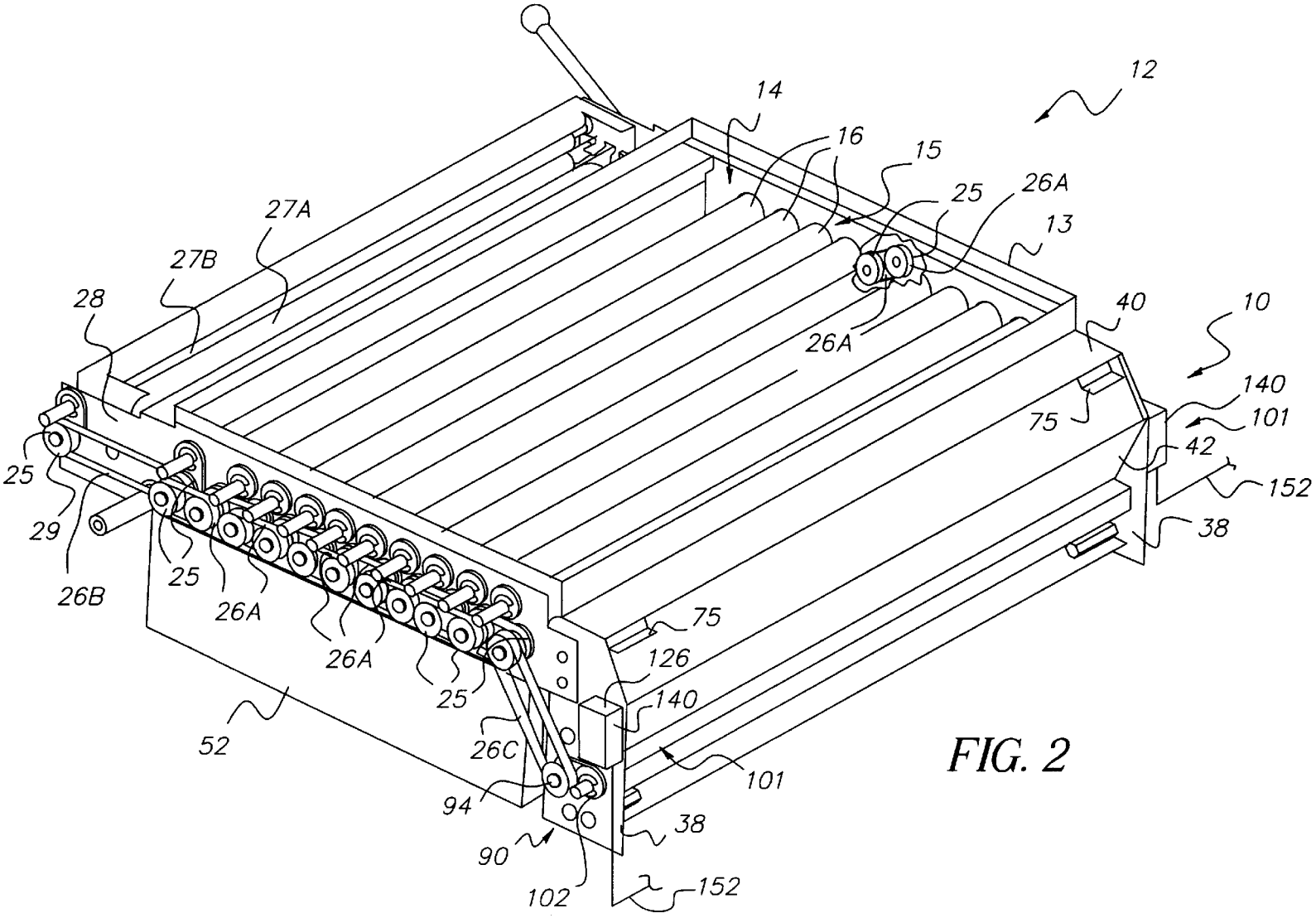
FIG. 2 is a perspective view of the photothermographic processor with the top removed therefrom and the cooling apparatus shown in FIG. 1.

An apparatus 10 for cooling a thermally processed, imaging element or material 11 in accordance with the present invention is illustrated generally in FIGS. 1 and 2. The cooling apparatus 10 forms part of a photothermographic processor 12 which includes a thermal processor 13. As seen best in FIG. 1, the thermal processor 13 has a heated enclosure oven 14 and an imaging material conveyance device 15 defined by a number of upper rollers 16 and lower rollers 17 arranged in a corrugated pattern. Upper and lower rollers 16 and 17 can include support rods 18 with cylindrical sleeves of a support material 20 which surrounds the external surface of the rods 18. The rods 18 are rotatably mounted to the opposite sides of the oven 14 to orient the rollers 16 and 17 in a spaced relationship about a transport path between an oven entrance 22 and an oven exit 24. The rollers 16 and 17 are positioned to contact the thermally processable material 11 I(hereinafter TPM 11).

Examples of thermally processable imaging materials include thermographic or photothermographic film (a film having a photothermographic coating or emulsion on at least one side). The term "imaging material" includes any material in which an image can be captured, including medical imaging films, graphic art films, imaging materials used for data storage and the like.

One or more of the rollers 16 and 17 of the imaging material conveyance device 15 can be driven in order to drive the TPM 11 through the oven 14 of the thermal processor 13. Preferably, as seen best in FIG. 2, all of the upper and lower rollers 16 and 17 are drive rolls. In one embodiment, at one side of the thermal processor 13, each of the lower rollers 17 includes a pair of pulleys 25 that allow adjacent lower rollers 17 to be coupled and driven through a series of drive belts 26A. As seen in the broken out portion of FIG. 2, on the opposite side of the thermal processor 13 each of the upper and lower rollers 16 and 17 includes a single pulley 25 that allow adjacent pairs of upper and lower rollers 16 and 17 to be coupled and driven through drive belts 26A. Alternatively, the upper and lower rollers 16 and 17 could all be driven through a series of coupled gears. In this embodiment, each of the upper and lower rollers 16 and 17 would include a single drive gear, with each gear of an upper roller 16 meshing with both gears of the two adjacent lower rollers 17 (i.e., in a zig-zag chain like arrangement).

As seen best in FIG. 1, the photothermographic processor 12 includes a pair of nip rollers 27A and 27B. The lower nip roller 27A is a drive roller while the upper nip roller 27B is a driven or idler roller. The lower nip roller 27A includes a single pulley 25 (FIG. 2) and is operably coupled to a drive motor 28 of the photothermographic processor 12 for driving lower nip roller 27A in a clockwise direction as represented by arrow 29. Adjacent to the oven entrance 22, is a pair of oven nip rollers 30A and 30B (FIG. 1). The lower nip roller 30A is a drive roller while the upper nip roller 30B is a driven or idler roller. Like one end of the lower rollers 17, the lower nip roller 30A includes a pair of pulleys 25 (FIG. 2) and is operably connected to the lower nip roller 27A through a drive belt 26B. The lower nip roller 30A in turn operably drives the lower rollers 17 through a further like drive belt 26A. Alternatively, the lower nip roller 30A could be operably coupled to the lower nip roller 27A and the lower drive rollers 17 through a series of gears. As a further alternative, the lower nip roller 30A and the upper and lower drive rollers 16 and 17 of the conveyance device 15 could be driven directly from the drive motor 28.

All of the pulleys 25 are identical so that all the upper and lower rollers 16 and 17, lower nip roller 27A and lower nip roller 30A operate (i.e., rotate) at the same operational rate of speed to convey the TPM 11 through the thermal processor 13 at a constant imaging material conveying rate of speed. The operational rate of speed of the upper and lower drive rollers 16 and 17 of the conveyance device 15 and the lower nip rollers 27A and 30A is substantially equal to the imaging material conveying rate of speed of the conveyance device 15 and nip rollers 27A and 30A. In one preferred embodiment, the operational and conveying rates of speed of the upper and lower drive rollers 16 and 17 of the conveyance device 15 and the lower nip rollers 27A and 30A is 0.54 inches per second as measured by the surface speed of the TPM 11 through the thermal processor 13.

As seen best in FIG. 1, the rollers 16 and 17 of the imaging material conveyance device 13 drive the TPM 11 through the oven 14 and adjacent to the heated members 32 which are heated via blanket heaters 34 of the thermal processor 13. The heated members 32 heat the TPM 11 to a first temperature to develop the latent image on the TPM 11. Once the latent image is developed, the TPM 11 passes out of the oven exit 24 and into a housing or cooling chamber 36 of the cooling apparatus 10. The cooling chamber 36 lowers the temperature of the TPM 11 to stop the thermal development while minimizing the creation of wrinkles in the TPM 11, the curling of the TPM 11, and the formation of other cooling defects. In addition, cooling of the TPM 11 allows a user to hold the TPM 11 to examine the developed image.

Figure 3:
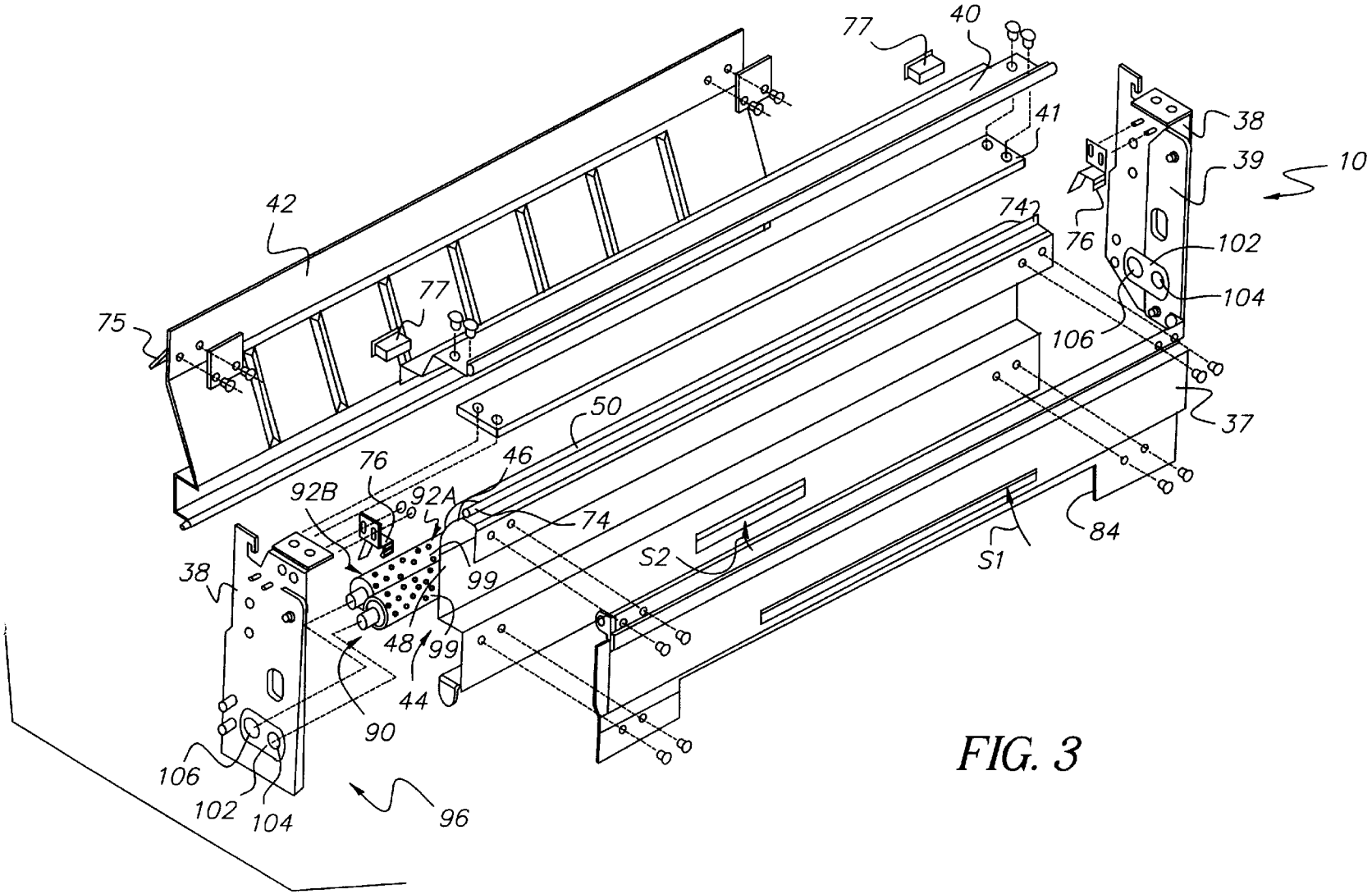
FIG. 3 is an exploded perspective view of the cooling apparatus shown in FIGS. 1 and 2.
Figure 8:
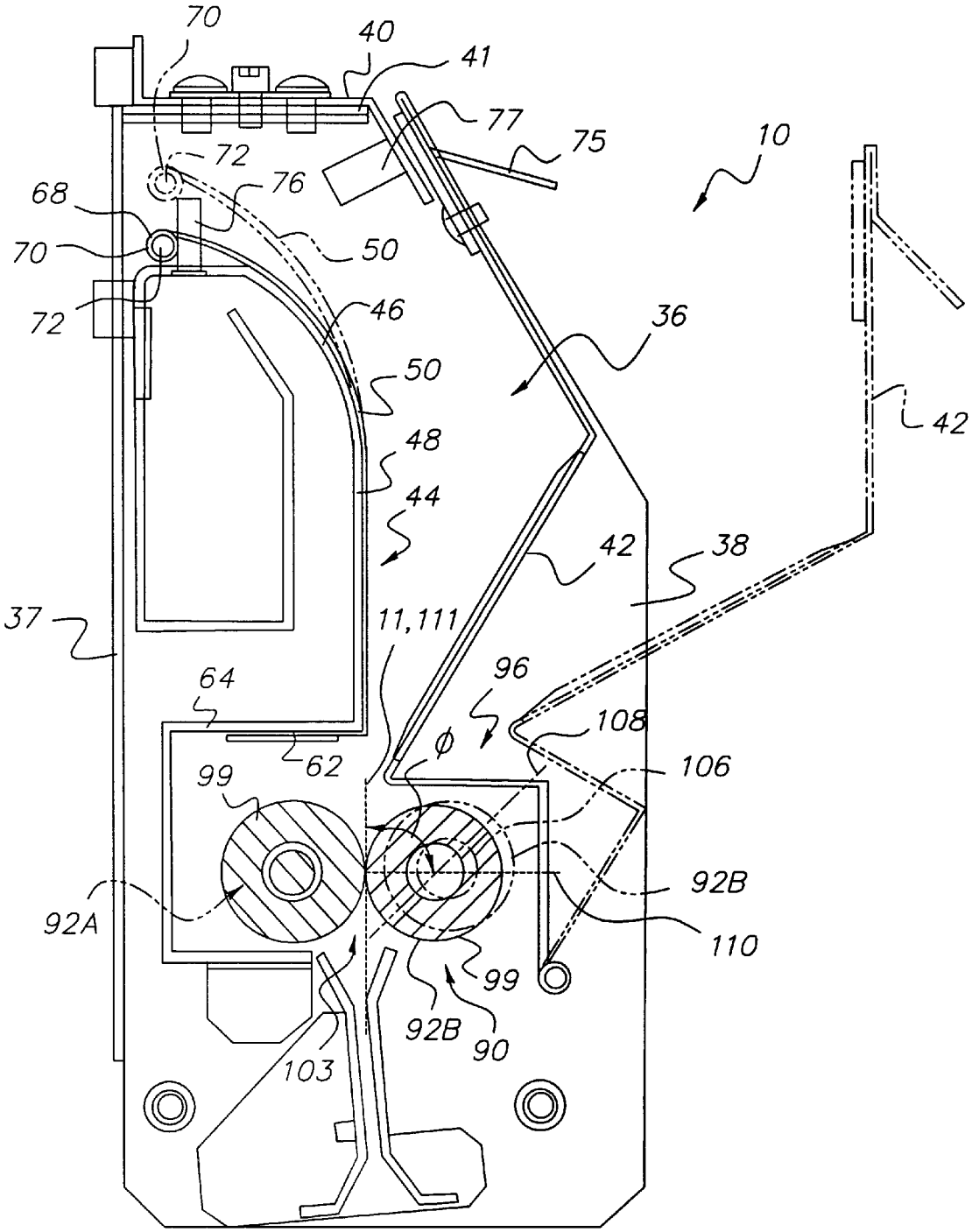
FIG. 8 is an enlarged side sectional view of the nip roller transport mechanism shown in FIGS. 4 and 5.

As seen best in FIGS. 1, 3 and 8, the cooling apparatus 10 includes a rear wall 37, opposite end walls 38 having reinforcing members 39, a top wall 40 having a reinforcing member 41 and a hinged cover member 42 that together define the cooling chamber 36. The rear wall 37 of the cooling apparatus 10 is positioned adjacent to the oven exit 24 of the thermal processor 13. Positioned within the cooling chamber 36 of the cooling apparatus 10 is a cooling article 44. The cooling article 44 has a second temperature that is lower than the first temperature of the TPM 11 as it exits the thermal processor 13. This acts to cool the heated TPM 11. The cooling article 44 includes a first, generally curved cooling section 46 and a second generally straight cooling section 48. Contact between the heated TPM 11 and the curved first cooling section 46 cools the TPM 11 while the TPM 11 is curved or bent. The degree of curving or bending increases the column stiffness of the TPM 11 which minimizes the formation of image and physical defects, such as wrinkles.

The location of the curved first cooling section 46 is also important. The curved first cooling section 46 of the cooling article 44 is located immediately at the oven exit 24 of the thermal processor 13 so as to receive the TPM 11 just after the TPM 11 is heated to the development processing temperature. With the correct location, curvature, and contact time with the TPM 11, the curved first cooling section 46 can cool a heated TPM 11 without the formation of image marring cooling induced wrinkles. Final cooling of the TPM 11 occurs as the heated TPM 11 passes over the straight second cooling section 48 of the cooling article 44. Because final cooling of the TPM 11 occurs while the TPM 11 is straight, curling of the TPM 11 can be minimized.

To control the cooling rate of the TPM 11, due to contact with the cooling article 44, the cooling article 44 is made of a combination of materials. Each of the materials has a different thermal conductivity. The first and second cooling sections 46 and 48 of the cooling article 44 are made of a relatively high thermal conductivity material (e.g., aluminum or stainless steel). This constitutes a first layer of the cooling article 44. This first high thermal conductivity layer is spaced from the imaging material to be cooled by a second layer of low thermal conductivity material (e.g., velvet or felt). This second layer is positioned on the first layer and directly contacts the imaging material to be cooled. This second low thermal conductivity layer takes the form of a single piece of material 50 that extends over both the first and second cooling sections 46 and 48 of the cooling article 44.

Figure 6:
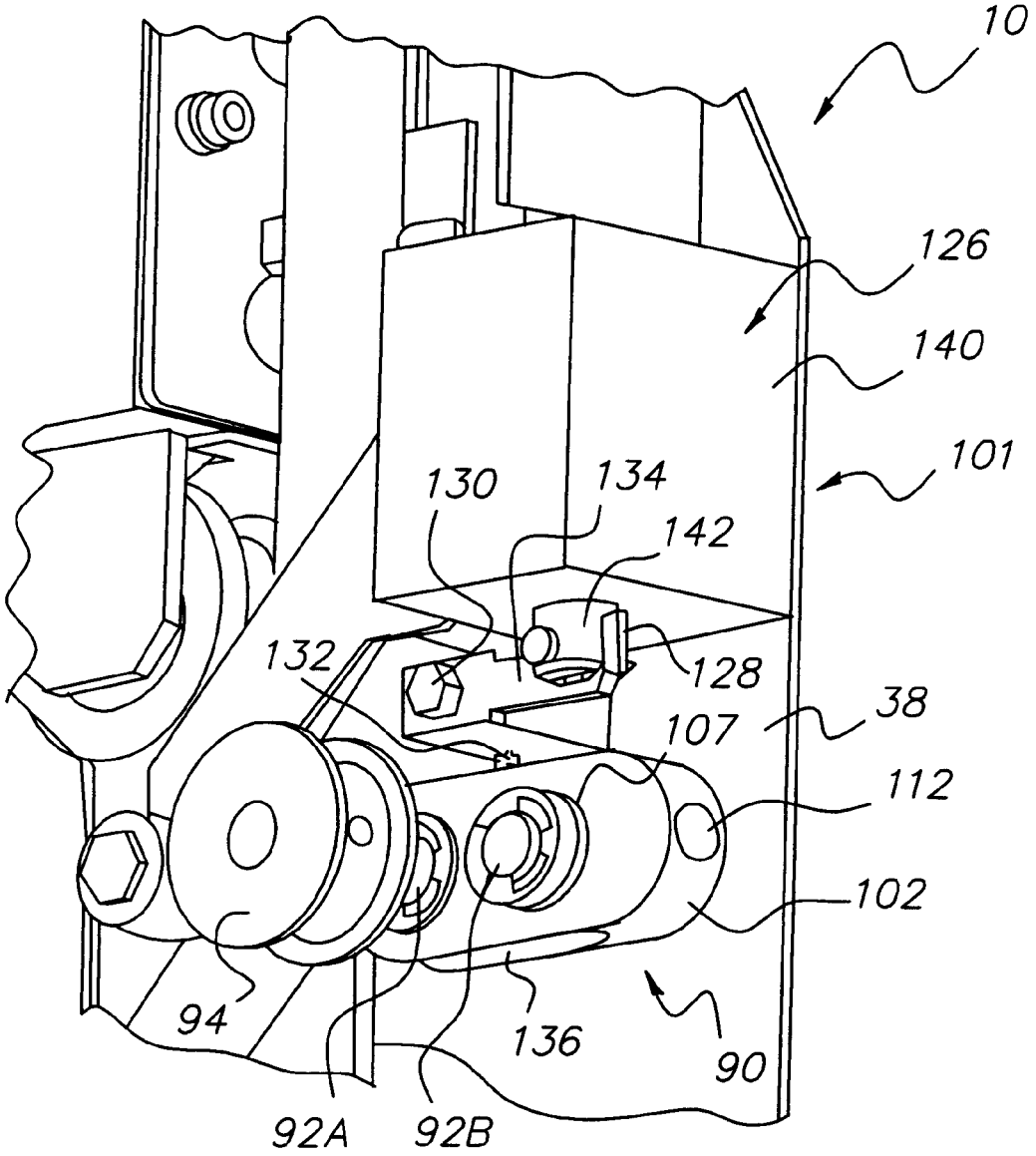
FIG. 6 is a partial perspective view of a displacement mechanism for the transport mechanism of the cooling apparatus.

The single piece of material 50 is designed to be readily removed from the cooling article 44 so that it can be periodically replaced. As seen best in FIG. 8, to this end, a first end 62 of the material 50 is attached to a median wall 64 of the cooling article 44 via a hook and loop separable fastener 66. A second end 68 of the material 50 includes a loop 70 that receives a rod element 72. Free ends 74 (FIG. 3) of the rod element 72 hook over bracket members 76 of the cooling apparatus 10. As seen best in FIG. 6, to remove/replace the material 50, handles 75 of the hinged cover 42 are grasped and the hinged cover 42 is opened by overcoming the attractive force of magnetic elements 77. The free ends 74 of the rod element 72 are then lifted clear of the bracket members 76 (see dashed line representation) to detach the first end 62 of the material 50 from the cooling article 44. The second end 68 of the material 50 is detached from the cooling article 44 by separating the hook and loop fastener 66. The material 50 is then removed from the cooling chamber 36. To load a replacement material 50 onto the cooling article 44 the above procedure is simply reversed.

As seen best in FIG. 1, the cooling apparatus 10 also makes use of first and second streams S1 and S2, respectively, of cooling air that further help to cool the TPM 11. The first stream S1 of cooling air is directed at a rear cooling surface 80 of the cooling article 44. The first stream S1 of cooling air can be created by a first fan 82 which pulls air in from outside the cooling apparatus 10 and directs the air against the rear cooling surface 80. This first stream S1 can exit the cooling apparatus 10 through an outlet 84. Alternatively, the first fan 82 could simply be omitted from the cooling apparatus 10 and cooling of the cooling article 44 could occur through simple convective ambient air circulation. The second stream S2 of cooling air can flow adjacent to the TPM 11 to remove gaseous by-products of the thermal development process. The second stream S2 can flow through the thermal processor 13 beginning at the oven entrance 22 and terminating at a filter/fan mechanism 86.

As seen in FIGS. 1–5, the cooling apparatus 10 further includes an imaging material transport mechanism 90 located adjacent to the straight, second cooling section 48 of the cooling article 44. The transport mechanism 90 includes a pair of nip rollers 92A and 92B for engaging the TPM 11 to convey the TPM 11 over the first and second cooling sections 46 and 48 of the cooling article 44. The nip roller 92A is a primary drive roller while the nip roller 92B is a secondary drive roller. As seen best in FIGS. 4 and 5, the primary drive nip roller 92A has a first end 91 and an opposite second end 93, and the secondary drive nip roller has a first end 95 and an opposite second end 96. A first end 91 of the primary drive nip roller 92A includes a pulley 94 that is operably connected to the drive motor 28 via a drive belt 26C coupled to the pulley 25 of the lower roller 17 that is nearest the oven exit 24 (FIG. 2). Alternatively, the primary drive nip roller 92A could be driven from the lower roller 17 through a series of gears, or the primary drive nip roller 92A could be driven directly from the drive motor 28.

Figure 9:
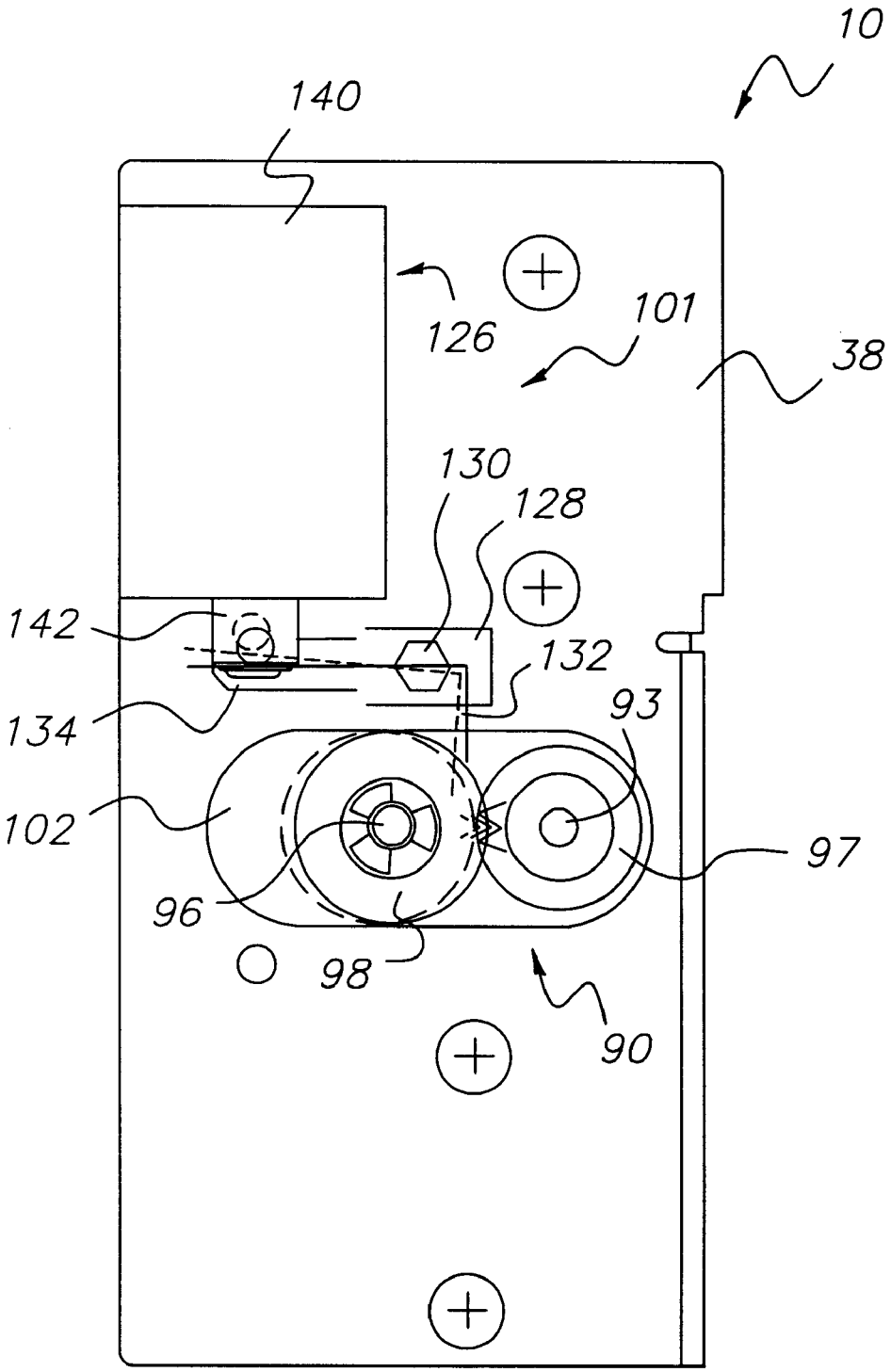
FIG. 9 is an enlarged side view of the displacement mechanism shown in FIGS. 6 and 7.

As seen in FIG. 9, the second end 93 of the primary drive nip roller 92A includes a first gear 97 that meshes with a second gear 98 on the second end 96 of the secondary drive nip roller 92B. In operation, the drive motor 28 drives the primary drive nip roller 92A through the pulleys 25 and 94 and the drive belts 26A, 26B and 26C. Upon rotation of the primary drive nip roller 92A, the secondary drive nip roller 92B is driven through the meshing of first and second gears 97 and 98. The imaging material transport mechanism 90 of the cooling apparatus 10 operates at an operational rate of speed and an TPM 11 conveying rate of speed that is substantially equal to the operational and conveying rates of speed of the of the imaging material conveyance device 15 of the thermal processor 13. Alternatively, the imaging material transport mechanism 90 could operate at an operational rate of speed and an TPM 11 conveying rate of speed that is slightly greater than the operational and conveying rates of speed of the of the imaging material conveyance device 15 of the thermal processor 13.

Figure 4:
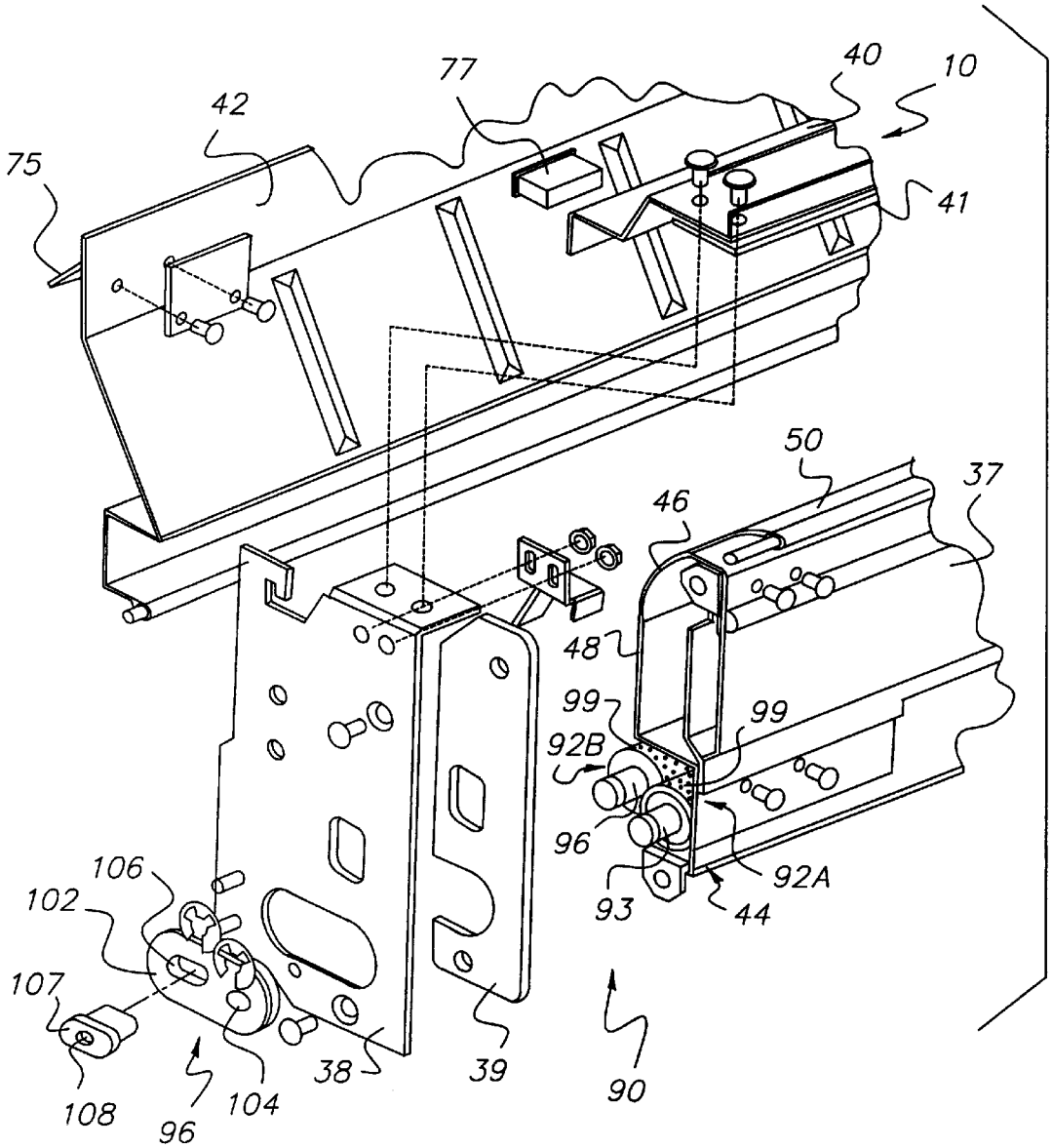
FIG. 4 is an enlarged, exploded perspective view illustrating details of one end of a nip roller, imaging material transport mechanism of the cooling apparatus.
Figure 5:
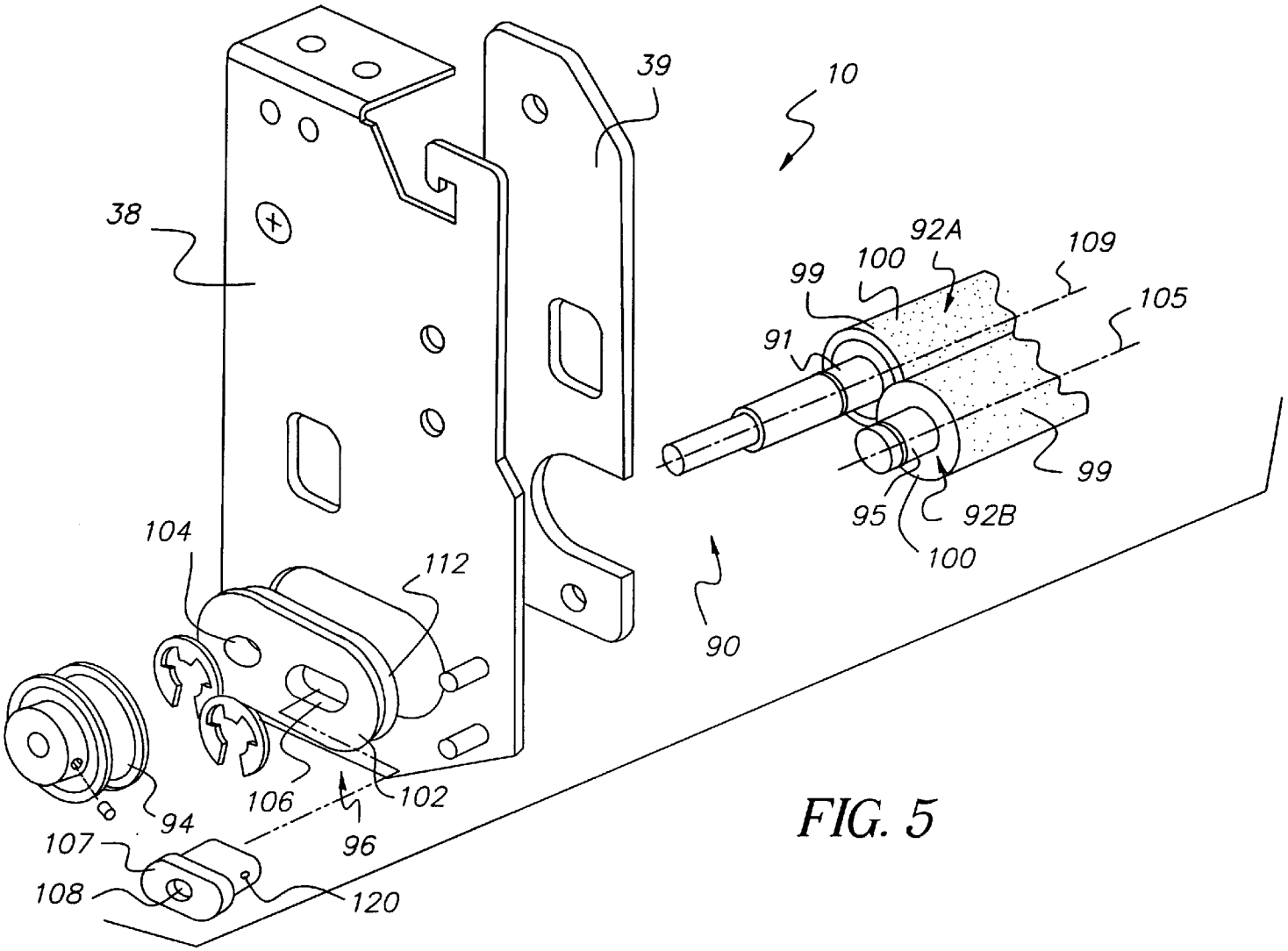
FIG. 5 is an enlarged, exploded perspective view illustrating details of an opposite end of the nip roller transport mechanism of the cooling apparatus shown in FIG. 4.

As seen best in FIGS. 3–5, the primary and secondary drive nip rollers 92A and 92B include an outer surface 99 that exhibits high friction to convey the TPM 11 over the cooling article 44. In one preferred embodiment each outer surface 99 of the primary and secondary drive nip rollers 92A and 92B is a urethane sleeve 100 (FIG. 5).

As seen best in FIGS. 2 and 4–9, the imaging material transport mechanism 90 includes a displacement mechanism 101 for effecting relative movement between the primary and secondary drive nip rollers 92A and 92B between a first position and a second position. In the first position (represented in dashed lines in FIG. 8), the primary and secondary rollers 92A and 92B engage the TPM 11 to convey the TPM 11 over the cooling article 44. In the second position (represented in solid lines in FIG. 8), the TPM 11 is substantially freely movable relative to the primary and secondary rollers 92A and 92B. In the second position, the outer surface 99 of the secondary drive nip roller 92B is separated from the outer surface 99 of the primary drive nip roller 92A by a nip opening 103 having a width greater than the thickness of the TPM 11 such that the TPM 11 is substantially freely movable through the nip opening 103. In one preferred embodiment, the width of the nip opening 103 is between 0.020" and 0.030" for a TPM 11 having a thickness of approximately 0.0040".

As seen best in FIGS. 4–7, the displacement mechanism 101 includes first and second main bearing block elements 102 for mounting the primary and secondary drive nip rollers 92A and 92B within the cooling apparatus 10. The first and second main bearing block elements 102 are identical to one another. Each bearing block element 102 includes a round aperture 104. The round apertures 104 support opposite ends 91 and 93 of the primary drive nip roller 92A. The round apertures 104 limit the primary drive nip roller 92A to rotational movement about a fixed rotational axis 105 (FIG. 5).

Figure 7:
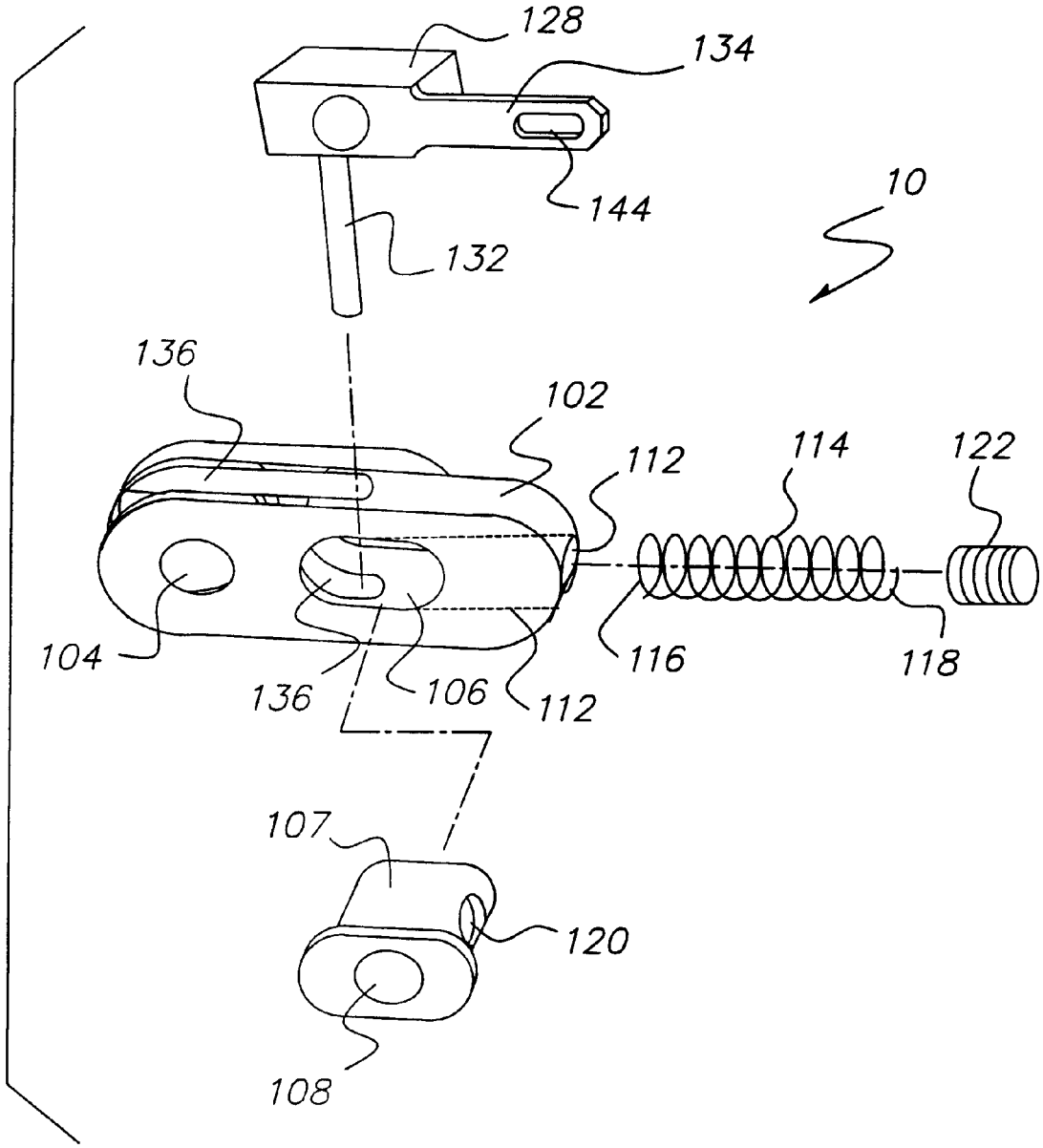
FIG. 7 is an exploded perspective view of some of the components of the displacement mechanism shown in FIG. 6.

As seen best in FIG. 7, each bearing block element 102 further includes a longitudinally extending slot 106. Each longitudinally extending slot 106 supports a bearing member 107 that is slidably movable within the slot 106 relative to the bearing block element 102. Each bearing member 107 includes a round aperture 108. The round apertures 108 support opposite ends 95 and 96 of the secondary drive nip roller 92B. The round apertures 108 limit the secondary drive nip roller 92B to rotational movement about a rotational axis 109 (FIG. 5). However, since the bearing members 107 are longitudinally, slidably movable within the slots 106 of the main bearing block elements 102, the secondary drive nip roller 92B is longitudinally movable relative to the main bearing block elements 102, and thereby longitudinally movable relative to the primary drive nip roller 92A between the above referenced first and second positions. When the secondary drive nip roller 92B is in the first position, the second position or during longitudinal movement of the secondary drive nip roller 92B between the first and second positions, the rotational axis 109 of the secondary drive nip roller 92B is substantially parallel to the fixed rotational axis 105 of the primary drive nip roller 92A.

The slots 106 allow the secondary drive nip roller 92B to longitudinally slidably move towards and away from the primary drive nip roller 92A between the first and second positions along longitudinal axes 110 of the slots 106 (see the solid line and dashed line representations of the secondary drive nip roller 92B in FIG. 8). As seen in FIG. 8, each of the longitudinal axes 110 of the slots 106 forms an angle Φ substantially at a 90° angle with respect to a single line 111 (that coincides with the path of the TPM 11) that is tangent to both the primary and secondary drive nip rollers 92A and 92B and is parallel to the straight second cooling section 48 of the cooling article 44.

Each of the main bearing block elements 102 further includes a bore 112 that extends from an outer surface of the bearing block element 102 to the longitudinally extending slot 106. The bores 112 are coincident with the longitudinal axes 110 of the slots 106. As seen best in FIG. 7, each bore 112 is adapted to receive a biasing member, such as a compression spring 114 having a first end 116 and a second end 118. The first end 116 of the spring 114 is received within a depression 120 in the bearing member 107. The spring 114 is further held within the bore 112 by way of a set screw 122 that bears against the second end 118 of the spring 114 and threadably engages the bore 112. The springs 114 produce a biasing force that acts between the set screws 122 of the main bearing block elements 102 and the depressions 120 of the slidable bearing members 107. This biasing force provided by the springs 114 moves the slidable bearing members 107 along the longitudinally extending slots 106, and thereby urges (i.e., moves) the secondary drive nip roller 92B along the longitudinal axes 110 of the slots 106 to the first position. The biasing force provided by the springs 114 biases the secondary drive nip roller 92B towards the primary drive nip roller 92A so as to provide enough force to grip the TPM 11 and convey the TPM 11 over the cooling article 44. Absent the TPM 11, the biasing force of the springs 114 causes the outer surface 99 of the secondary drive nip roller 92B to contact the outer surface 99 of the primary drive nip roller 92A. In one preferred embodiment, each spring 114 exerts one pound of biasing force against the secondary drive nip roller 92B.

As seen in FIGS. 2, 6, 7 and 9, the displacement mechanism 96 further includes a drive assembly 126 for moving the secondary drive nip roller 92B relative to the primary drive nip roller 92A from the first position to the second position against the biasing force of the springs 114. The drive assembly 126 includes a pair of L-shaped drive assembly links 128. One of the drive assembly links 128 is pivotally mounted on a pivot post 130 adjacent to each main bearing block element 102. Each L-shaped drive assembly link 128 includes a first leg 132 and a second leg 134 substantially perpendicular to the first leg 132. The L-shaped drive assembly links 128 are mirror images of one another. Each first leg 132 is received within a respective channel 136 within the main bearing block elements 102. Each of the channels 136 extends from an outer surface of the bearing block element 102 to the longitudinally extending slot 106. The first legs 132 of the drive assembly links 128 bear against the slidable bearing members 107 on the sides of the bearing members 107 opposite the depressions 120. The drive assembly 126 further includes a pair of drive assembly motors, such as linear solenoids 140. One of the linear solenoids 140 is mounted adjacent to each L-shaped drive assembly link 128. Each linear solenoid 140 includes a linearly movable actuator 142 that is operably coupled to a slot 144 within a respective second leg 134 of the L-shaped drive assembly links 128. The linear solenoids 140 are identical to one another.

As seen best in FIG. 9, actuation of the linear solenoids 140 causes retraction of the linearly movable actuators 142 and thereby pivotal movement of the drive assembly links 128 about the pivot posts 130. This in turn causes longitudinal movement of the slidable bearing members 107 along the slots 106 of the main bearing block elements 102, and thereby longitudinal movement of the secondary drive nip roller 92B relative to the primary drive nip roller 92A (against the biasing force of the springs 114) from the first position (shown in solid lines in FIG. 9) to the second position (shown in dashed lines in FIG. 9). Deactivation of the linear solenoids 140 causes extension of the linearly movable actuators 142, which together with the biasing force of the springs 114, causes reverse pivotal movement of the drive assembly links 128 and movement of the secondary drive nip roller 92B from the second position back to the first position.

As seen in FIGS. 1 and 2, to control operation of the linear solenoids 140, each linear solenoid is linked to a controller 150 via communication lines 152. The controller 150 includes a microprocessor. The controller 150 is further linked, via communication line 154, to a sensor 156 positioned outside the heated enclosure oven 14 of the thermal processor 13. The sensor 156 is located adjacent to the oven entrance 22. The controller 150 controls operation of linear solenoids 140, and thereby movement of the secondary drive nip roller 92B between the first and second positions, based upon information obtained from the sensor 156 related to the location of the TPM 11.

Between the first and second positions, the secondary drive nip roller 92B moves a total of distance of only between 0.020" and 0.030". As seen in FIG. 9, this allows the first and second gears 97 and 98 mounted on the primary and secondary drive nip rollers 92A and 92B to mesh and thereby rotate whether the rollers 92A and 92B are in the first position or in the second position.

In practice, prior to the TPM 11 entering the thermal processor 13, the primary and secondary drive nip rollers 92A and 92B are in the first position. The nip rollers 27A and 27B transport the TPM 11 to the oven entrance 22 of the heated enclosure oven 14 of the thermal processor 13. It is at this point, just before the oven entrance 22, that a leading edge of the TPM 11 is sensed by the sensor 156 which starts an internal timer within the controller 150. Once the TPM 11 enters the heated enclosure oven 14 of the thermal processor 13, the oven nip rollers 30A and 30B assist in the transport of the TPM 11. The TPM 11 continues to be transported through the thermal processor 13 with the further assistance of the conveyance device 15. Eventually, an initial portion of the TPM 11 exits the thermal processor through the oven exit 24 where this initial portion of the TPM 11 passes over the cooling article 44 and is cooled. Just prior to the leading edge of the TPM 11 reaching the rotating primary and secondary drive nip rollers 92A and 92B, the internal timer within the controller 150 initiates the controller 150 to activate the linear solenoids 140 to move the secondary drive nip roller 92B from the first position to the second position to create the nip opening 103. The precise moment at which the internal timer of the controller 150 initiates the controller is computed based upon the known speed of the TPM 11 through the thermal processor 13 and the known distance that the TPM 11 travels through the thermal processor 13. At this point, the primary and secondary drive nip rollers 92A and 92B are still rotating but the nip opening 103 allows this initial portion of the TPM 11 to substantially freely pass through the nip opening 103 substantially unimpeded by the rollers 92A and 92B.

The TPM 11 is substantially freely movable through the nip opening 103 in the sense that absent the imaging material conveyance device 15, the TPM 11 would simply fall through the nip opening 103 created by the second position of the rollers 92A and 92B. In practice, since the TPM 11 is flexible by nature, there is some inadvertent contact between the TPM 11 and the rollers 92A and 92B as the TPM 11 passes through the nip opening 103. However, since the primary and secondary drive nip rollers 92A and 92B of the imaging material transport mechanism 90 rotate at an operational rate of speed and a TPM 11 conveying rate of speed that is substantially equal to the operational and conveying rates of speed of the of the imaging material conveyance device 15 of the thermal processor 13, any inadvertent contact of the TPM 11 with the rollers 92A and 92B tends to have a desired smoothing effect on the TPM 11 which helps to prevent image marring wrinkling of the TPM 11.

As stated previously, alternatively, the primary and secondary drive nip rollers 92A and 92B of the imaging material transport mechanism 90 could operate (i.e., rotate) at an operational rate of speed and a TPM 11 conveying rate of speed that is slightly greater than the operational and conveying rates of speed of the of the imaging material conveyance device 15 of the thermal processor 13. One way to achieve this speed differential, is through the pulley 94 of the primary drive nip roller 92A. The pulley 94 could have one or more fewer teeth than the number of teeth used in the pulleys 25. This would cause the primary and secondary drive nip rollers 92A ands 92B to rotate faster than the upper and lower rollers 16 and 17. This speed differential would also exhibit a desired smoothing effect on the TPM 11 upon inadvertent contact of the TPM 11 with the rollers 92A and 92B. This smoothing effect helps to prevent image marring wrinkling of the TPM 11.

As a trailing edge of the TPM 11 nears the oven exit 24 and is about to lose driving contact with the conveyance device 15, the timer of the controller 150 deactivates the linear solenoids 140 to allow the secondary drive nip roller 92B to move to the first position. This deactivation occurs at this precise moment via the timer within the controller 150 which operates based upon the known speed of the TPM 11 and the distance traveled by the TPM 11 through the thermal processor 13. With the primary and secondary drive nip rollers 92A and 92B in the first position, both the conveyance device 15 and the rollers 92A and 92B are working to convey a further portion of the TPM 11 over the cooling article 44. The conveyance device 15 and the rollers 92A and 92B work together to convey the TPM 11 over the cooling article 44 for only a very short period of time, of approximately 1.0 second. Once the trailing edge of the TPM 11 leaves the conveyance device 15 only the rollers 92A and 92B act to convey a final portion of the TPM 11 over the cooling article 44. Once the TPM 11 has exited the primary and secondary drive nip rollers 92A and 92B, the timer resets the controller 150 and the primary and secondary drive nip rollers 92A and 92B remain in the first position to make ready for the next piece of TPM 11.

In the alternative embodiment, wherein the primary and secondary drive nip rollers 92A and 92B of the imaging material transport mechanism 90 are operating (i.e., rotating) at an operational rate of speed and a TPM 11 conveying rate of speed that is slightly greater than the operational and conveying rates of speed of the of the imaging material conveyance device 15 of the thermal processor 13, the speed of the rollers 92A and 92B would automatically be reduced during cooling of the final portion of the TPM 11 to insure that the TPM 11 is in contact with the cooling article 44 for a sufficient amount of time.

This cooling apparatus 10 and method minimizes formation of physical and image defects during cooling of the TPM 11. Because the heated TPM 11 is substantially freely movable relative to the rollers 92A and 92B of the transport mechanism 90 during substantially the entire transport of the TPM 11 through the thermal processor 13, any formation of imaging material physical and image defects due to a speed mismatch between the conveyance device 15 and the transport mechanism 90 is essentially eliminated. Since only the conveyance device 15 primarily conveys the heated TPM 11 over the cooling article 44 during the transport of the TPM 11 through the processor 13, and since only the transport mechanism 90 primarily conveys the TPM 11 over the cooling article 44 once the TPM 11 has exited the thermal processor 13, buckling of the TPM 11 or slippage induced high tension in the TPM 11 due to a speed mismatch, and the subsequent defects caused thereby, is minimized.

Moreover, substantially free movement of the heated TPM 11 relative to the rollers 92A and 92B of the transport mechanism 90, during substantially the entire transport of the TPM 11 through the thermal processor 13, permits cross-web expansion and contraction of the TPM 11. By permitting cross-web expansion and contraction during cooling, the formation of physical and image defects, that would otherwise occur in the TPM 11 if cross-web expansion and contraction were not permitted, are virtually eliminated. In addition, substantially free movement of the heated TPM 11 relative to the rollers 92A and 92B of the transport mechanism 90, during substantially the entire transport of the TPM 11 through the thermal processor 13, allows the heated TPM 11 to enter the transport mechanism 90 in a skewed condition while still maintaining uniform contact with the cooling article 44. This uniform contact minimizes the formation of imaging material physical and image defects caused by uneven cooling of the TPM 11, and the possibility of imaging material jams. The cooling apparatus 10 of the present invention minimizes physical and image artifacts while offering acceptable cooling productivity, cost effectiveness and ease of assembly and repair. The overall result is a significant improvement in the quality of the developed image on the TPM 11.

Although the present invention has been described with reference to preferred embodiments, workers skilled in the art will recognize that changes may be made in form and detail without departing from the spirit and scope of the invention.

What is claimed is:

1. An apparatus for cooling a thermally processed, imaging material which has been heated to a first temperature by a thermal processor, the cooling apparatus comprising:

an imaging material conveyance device associated with said thermal processor;

a cooling article on which the imaging material rides after the imaging material exits the thermal processor at the first temperature, the cooling article having a second temperature that is lower than the first temperature so as to cool the imaging material; and an imaging material transport mechanism adjacent the cooling article for engaging the imaging material to convey the imaging material over the cooling article, the transport mechanism including:

a first roller;

a second roller;

a displacement mechanism for effecting relative movement between the first and second rollers, such that in a first position of the first and second rollers, the first and second rollers engage the imaging material to convey the imaging material over the cooling article, and in a second position of the first and second rollers the imaging material is substantially freely movable relative to the first and second rollers; and control means for controlling said imaging material conveyance device and said imaging material transport mechanism: (1) to transport said imaging material over said cooling article using only said imaging material conveyance device, said displacement mechanism being in said second position; (2) to further transport said imaging material over said cooling article using both said imaging material conveyance device and said imaging material transport mechanism, said displacement mechanism being in said first position; and (3) to additionally transport said imaging material over said cooling article using only said imaging material transport mechanism, said displacement mechanism being in said first position.

2. The cooling apparatus of claim 1 wherein to effect relative movement between the first and second rollers, the displacement mechanism moves the second roller relative to the first roller between the first and second positions.

3. The cooling apparatus of claim 2 wherein the first roller is rotatable about a fixed rotational axis, and wherein the second roller is rotatable about a movable rotational axis.

4. The cooling apparatus of claim 3 wherein the displacement mechanism moves the second roller relative to the first roller such that the movable rotational axis of the second roller is displaced relative to the fixed axis of the first roller, and wherein in both the first and second positions the movable rotational axis of the second roller is substantially parallel to the fixed rotational axis of the first roller.

5. The cooling apparatus of claim 1 wherein each of the first and second rollers has an outer surface, and wherein in the second position of the first and second rollers, the outer surfaces of the first and second rollers are separated by a nip opening.

6. The cooling apparatus of claim 5 wherein the imaging material has a thickness, and wherein a width of the nip opening is greater than the thickness of the imaging material such that the imaging material is substantially freely movable through the nip opening.

7. The cooling apparatus of claim 5 said first and second rollers are located relative to each other such that wherein in the first position, the outer surface of the second roller contacts the outer surface of the first roller when the first and second rollers are free from contact with the imaging material.

8. The cooling apparatus of claim 2 wherein the displacement mechanism includes:

a drive assembly for moving the second roller relative to the first roller from the first position to the second position.

9. The cooling apparatus of claim 2 wherein the displacement mechanism includes:

a biasing mechanism producing a biasing force that moves the second roller towards the first roller from the second position to the first position.

10. The cooling apparatus of claim 9 wherein the displacement mechanism further includes:

a drive assembly for moving the second roller relative to the first roller from the first position to the second position against the biasing force of the biasing mechanism.

11. The cooling apparatus of claim 2 wherein the second roller is rotatable about a rotational axis, and the cooling apparatus further includes:

a drive apparatus for rotating the second roller about its rotational axis in both the first and the second positions.

12. The cooling apparatus of claim 2 wherein the first roller is rotatable about a rotational axis, and the cooling apparatus further includes:

a drive apparatus for rotating the first roller about its rotational axis in both the first and second positions.

13. The cooling apparatus of claim 12 wherein the second roller is rotatable about a rotational axis, and wherein the drive apparatus rotates the second roller about its rotational axis in both the first and second positions.

14. The cooling apparatus of claim 1 wherein the cooling apparatus includes a housing within which the cooling article is mounted.

15. The cooling apparatus of claim 14 wherein the displacement mechanism includes:

first and second main bearing elements mounted to the housing of the cooling apparatus, the first and second main bearing elements supporting first and second opposite ends of the first roller such that the first roller is rotatable about a fixed rotational axis.

16. The cooling apparatus of claim 15 wherein each of the first and second main bearing elements defines a longitudinally extending slot, the longitudinally extending slots of the first and second main bearing elements supporting first and second opposite ends of the second roller such that the second roller is rotatable about a rotational axis and longitudinally movable relative to the first roller and the first and second main bearing elements between the first and second positions.

17. The cooling apparatus of claim 16 wherein the rotational axis of the second roller remains substantially parallel to the fixed rotational axis of the first roller during longitudinal movement of the second roller between the first and second positions.

18. The cooling apparatus of claim 17 wherein the rotational axis of the second roller is substantially parallel to the fixed rotational axis of the first roller in the first and second positions.

19. The cooling apparatus of claim 16 wherein each of the first and second main bearing elements includes:

a bearing member slidably movable along the longitudinally extending slot, the bearing members receiving respective first and second ends of the second roller to permit rotational movement of the second roller about its rotational axis.

20. The cooling apparatus of claim 19 wherein each of the first and second main bearing elements further includes:

a biasing member producing a biasing force that acts between the first and second main bearing elements and the slidable bearing members to move the second roller towards the first roller from the second position to the first position.

21. The cooling apparatus of claim 20 wherein each biasing member is a spring.

22. The cooling apparatus of claim 20 wherein the displacement mechanism further includes:

a drive assembly for moving the second roller relative to the first roller from the first position to the second position against the biasing force of the biasing members.

23. The cooling apparatus of claim 22 wherein the drive assembly includes:

a drive assembly link pivotally mounted to the housing of the cooling apparatus, the drive assembly link having a first end engaged with the slidable bearing member of the first main bearing element and a second end; and a drive assembly motor operably connected to the second end of the drive assembly link, such that operation of the drive assembly motor causes pivotal movement of the drive assembly link and longitudinal movement of the slidable bearing members and the second roller relative to the first and second main bearing elements.

24. The cooling apparatus of claim 23 wherein the drive assembly further includes:

a further drive assembly link pivotally mounted to the housing of the cooling apparatus, the further drive assembly link having a first end engaged with the slidable bearing member of the second main bearing element and a second end; and a further drive assembly motor operably connected to the second end of the further drive assembly link, such that operation of the drive assembly motor and the further drive assembly motor causes pivotal movement of the drive assembly link and the further drive assembly link and longitudinal movement of the slidable bearing members and the second roller relative to the first and second main bearing elements.

25. The cooling apparatus of claim 24 wherein each of the drive assembly motor and the further drive assembly motor is a linear solenoid.

26. The cooling apparatus of claim 23, and further including:

a sensor for determining a location of the imaging material within the thermal processor;

a controller linked to the sensor and the drive assembly motor for controlling operation of the drive assembly motor to move the second roller between the first and second positions based upon the location of the imaging material within the thermal processor.

27. The cooling apparatus of claim 16, and further including:

a drive apparatus for rotating the first roller about its fixed rotational axis and the second roller about its rotational axis in both the first and second positions.

28. The cooling apparatus of claim 27 wherein the drive apparatus includes:

a drive apparatus motor operably coupled to the first roller to rotate the first roller about its rotational axis;

a first gear on one end of the first roller; and a second gear on one end of the second roller, the second gear engaging the first gear in both the first and second positions, such that rotation of the first roller about its rotational axis causes rotation of the second roller about its rotational axis.

29. The cooling apparatus of claim 19 wherein the each of the longitudinally extending slots of the first and second main bearing elements has a longitudinal axis, and wherein each longitudinal axis forms substantially a 90° angle with respect to a single line tangent to both the first and second rollers.

30. A method of cooling a thermally processed imaging material which has been heated to a first temperature by a thermal processor having an imaging material conveyance device, the method comprising the steps of:

transporting the heated imaging material over a cooling article at an exit of the thermal processor using only the imaging material conveyance device, the cooling article having a second temperature lower than the first temperature so as to cool an initial portion of the imaging material, the imaging material being substantially freely movable relative to an imaging material transport mechanism located subsequent to the cooling article;

further transporting the heated imaging material over the cooling article using both the imaging material conveyance device and the imaging material transport mechanism to cool a further portion of the imaging material; and additionally transporting the heated imaging material over the cooling article using only the imaging material transport mechanism to cool a final portion of the imaging material.

31. The method of claim 30 wherein the step of transporting the heated imaging material includes the step of:

effecting relative movement between first and second rollers of the imaging material transport mechanism prior to the imaging material reaching the transport mechanism, the first and second rollers being moved from a first position, wherein the first and second rollers are capable of engaging the imaging material for conveying the imaging material over the cooling article, to a second position, wherein the imaging material is substantially freely movable relative to the first and second rollers.

32. The method of claim 31 wherein the step of further transporting the heated imaging material includes the step of:

effecting relative movement between the first and second rollers of the imaging material transport mechanism just prior to the imaging material exiting the imaging material conveyance device, the first and second rollers being moved from the second position, wherein the imaging material is substantially freely movable relative to the first and second rollers, to the first position, wherein the first and second rollers engage the imaging material for conveying the imaging material over the cooling article.

33. An apparatus for cooling a thermally processed, imaging material which has been heated to a first temperature by a thermal processor having an imaging material conveyance device operating at a first operational rate of speed, the cooling apparatus comprising:

a cooling article on which the imaging material rides after the imaging material exits the thermal processor at the first temperature, the cooling article having a second temperature that is lower than the first temperature so as to cool the imaging material; and an imaging material transport mechanism adjacent the cooling article for engaging the imaging material to convey the imaging material over the cooling article, the transport mechanism including:

a first roller having an outer surface and being rotatable about a first rotational axis;

a second roller having an outer surface and being rotatable about a second rotational axis, the outer surfaces of the first and second rollers being separated by a nip opening having a width greater than a thickness of the imaging material, such that the imaging material is substantially freely movable through the nip opening and upon inadvertent contact of the imaging material with the outer surface of one of the first and second rollers, rotation of the first and second rollers about the first and second rotational axes has a non-wrinkling, smoothing effect on the imaging material.

34. The cooling apparatus of claim 33, and further including:

a drive apparatus operably coupled to the first and second rollers for rotating the first and second rollers about the first and second rotational axes at second operational rate of speed.

35. The cooling apparatus of claim 34 wherein the second operational rate of speed of the drive apparatus is substantially equal to the first operational rate of speed of the imaging material conveyance device.

36. The cooling apparatus of claim 34 wherein the second operational rate of speed of the drive apparatus is different than the first operational rate of speed of the imaging material conveyance device.

37. The cooling apparatus of claim 36 wherein the second operational rate of speed of the drive apparatus is greater than the first operational rate of speed of the imaging material conveyance device.

* * * * *